US006211836B1

(12) United States Patent
Manasson et al.

(10) Patent No.: US 6,211,836 B1
(45) Date of Patent: Apr. 3, 2001

(54) SCANNING ANTENNA INCLUDING A DIELECTRIC WAVEGUIDE AND A ROTATABLE CYLINDER COUPLED THERETO

(75) Inventors: Vladimir Manasson, Los Angeles; Lev Sadovnik, Irvine, both of CA (US)

(73) Assignee: Waveband Corporation, Torrance, CA (US)

( * ) Notice: Subject to any disclaimer, the term of this patent is extended or adjusted under 35 U.S.C. 154(b) by 0 days.

(21) Appl. No.: 09/363,729

(22) Filed: Jul. 30, 1999

(51) Int. Cl.[7] ..... H01Q 13/00

(52) U.S. Cl. ..... 343/785; 343/781 R; 343/781 P; 333/248

(58) Field of Search ..... 343/754, 757, 343/761, 772, 776, 779, 782, 783, 785, 781 R, 781 P; 333/135, 137, 248

(56) References Cited

U.S. PATENT DOCUMENTS 2,993,205 * 7/1961 Cooper ..... 343/785
4,001,835 * 1/1977 Dover et al. ..... 343/754
5,014,069 * 5/1991 Seiler et al. ..... 343/785
5,572,228 11/1996 Manasson et al. ..... 343/785
5,815,124 9/1998 Manasson et al. ..... 343/785

* cited by examiner

*Primary Examiner*—Tan Ho
(74) *Attorney, Agent, or Firm*—Herbert M. Shapiro

(57) ABSTRACT

A scanning antenna includes a cylinder coupled to a dielectric waveguide into which an electromagnetic wave is launched. The cylinder includes rows of features such as recesses or stubs of differing vertical dimensions and periods. The cylinder when rotated directs the coupled radiation over a range determined by the periods of features in the rows and the rotation of the cylinder. Both transmitters and receivers are described. Benefits are described in connection with different cross section geometries to the waveguide. Also, both linear and circular polarization operations are described.

18 Claims, 10 Drawing Sheets

SCANNING ANTENNA INCLUDING A DIELECTRIC WAVEGUIDE AND A ROTATABLE CYLINDER COUPLED THERETO

FIELD OF THE INVENTION

This invention relates to scanning antennas and more particularly to such antennas which steer electromagnetic radiation from a dielectric waveguide in directions determined by the geometry of a rotatable cylinder (or drum) coupled to it.

BACKGROUND OF THE INVENTION

U.S. Pat. No. 5,572,228 issued Nov. 5, 1996 and U.S. Pat. No. 5,815,124 issued Sep. 29, 1998 describe evanescent coupling antennas which employ rotatable cylinders placed in close proximity to a dielectric rod waveguide and operative to radiate the coupled energy in directions determined by the period of features on the surface of the cylinder. By defining rows of features where the features of each row have a different period, the radiation can be directed in a plane over a range determined by the different periods and by rotating the cylinder about an axis parallel to the axis of the waveguide.

The features on the cylinder surface, of each of the antennas disclosed in the above-noted patents, comprise conductor strips of like thickness and at a given and different spacing in each row about the cylinder. The operation of such an antenna as well as the advantages in such applications as vehicle collision avoidance systems for automobiles and aircraft and the like are described in the above-noted patents which are incorporated herein by reference.

BRIEF DESCRIPTION OF THE INVENTION

It has been discovered that by including features which vary in vertical dimension as well as in period from row to row, greater control over the transmitted (or received) waveform, arbitrary polarization, and increased gain are achieved. Accordingly, generic features of embodiments of this invention include a dielectric rod waveguide (DRW) with an electromagnetic wave launched therein and a rotatable cylinder including rows of generally circular recesses of different depths or generally circular stubs of different heights where the period in each row varies in a prescribed manner. The cylinder is rotated to scan that electromagnetic radiation over a lateral space determined by the varying feature periods and by the rotation of the cylinder.

DETAILED DESCRIPTION OF AN ILLUSTRATIVE EMBODIMENT OF THIS INVENTION

Figure 1:
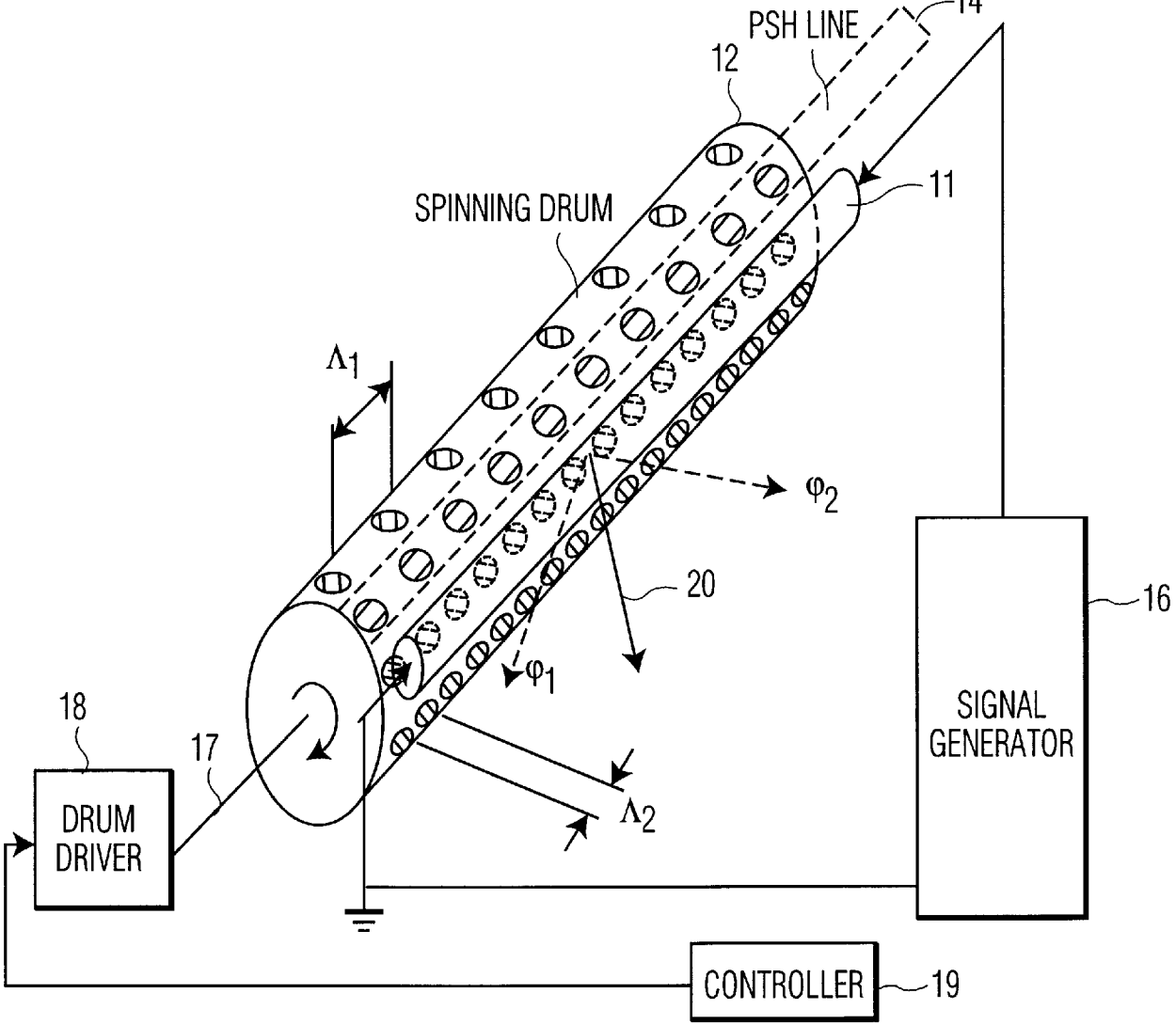
FIG. 1 is a schematic representation of a beam steering antenna including a dielectric waveguide and a spinning drum in accordance with the principles of this invention.

FIG. 1 shows a dielectric rod waveguide 11 placed in close proximity to a cylinder or drum 12. Drum 12 includes rows of recesses or holes where the holes of each row have a different period. A periodic set of holes in a representative row is shown in the figure as PSH line 14. It can be seen from the figure that the features have similar X and Y dimensions.

In operation, a signal is launched into waveguide 11 by signal generator 16 and drum 12 is rotated about an axis 17 by drum driver 18. The drum is made of metallic material and is coupled to the evanescent field generated by the signals in the waveguide in a manner fully described in the above-noted patents. Signal generator 16 and driver 18 are controlled by controller 19 in a well understood manner.

The apparatus of FIG. 1 is operative to radiate signals in lateral directions dictated by the period of the features (recesses) in each row of drum 12 as that row comes into alignment with the waveguide. As the drum spins, the direction of the (beam) radiation changes. By choosing the periods of the features in the rows carefully and by spinning the drum, the lateral space over which the beam is broadcast is determined. The direction of the beam radiated as the waveguide is in alignment with each of the consecutive rows of features is determined by the equation:

Coupling angle (for both transmitting and receiving):

$$\phi = \arcsin\,(C/V_{ph} - \lambda/A)$$

where C is the velocity of light, $V_{ph}$ is the phase velocity of the electromagnetic wave in the waveguide. $\lambda$ is the wavelength of the electromagnetic wave in free space and $\Lambda$ is the period of the features in the row. The direction of the radiated beam is indicated in FIG. 1 by the solid arrow 20 and the broken arrows $\phi_1$ and $\phi_2$ which indicate the plane of the beam.

Figure 2:
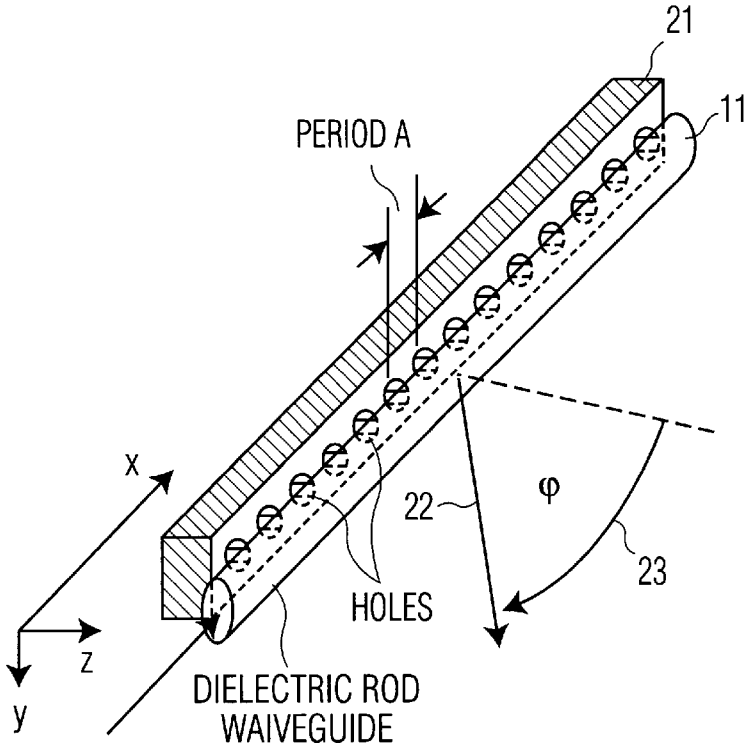
FIGS. 2 and 3 are schematic representations of a dielectric rod waveguide and a coupled row of the drum of FIG. 1 including recesses and stubs in the drum surface respectively.
Figure 3:
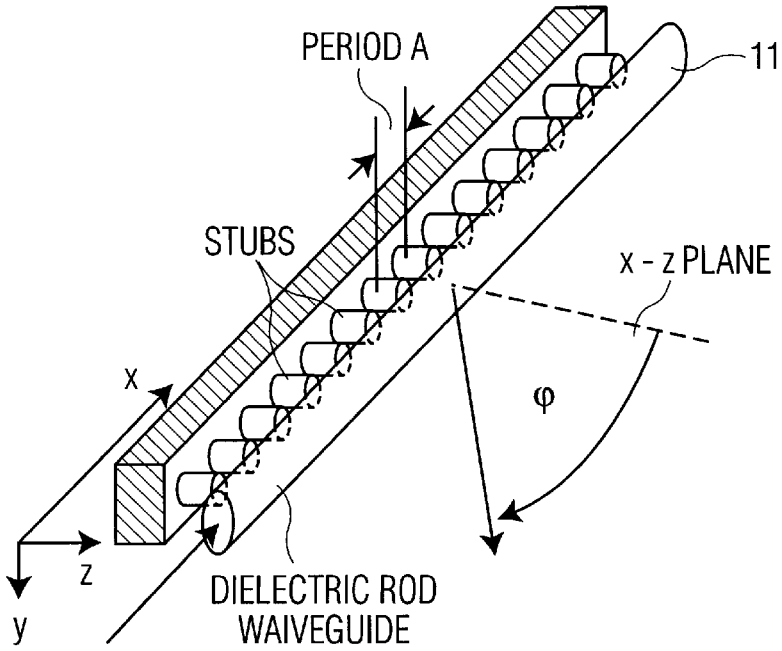

FIG. 2 shows an illustrative section 21 of drum 12 of FIG. 1 with a row of holes aligned with waveguide 11. The radiated beam is indicated by arrow 22 and the plane of radiation is indicated by curved arrow 23. FIG. 3 shows an arrangement analogous to that shown in FIG. 2 except that the features of the illustrative section of the drum comprise stubs rather than holes.

Figures 4A, 4B, 4C, 4D, 4E, 4F, 4G, 4H, 4I, 4J:
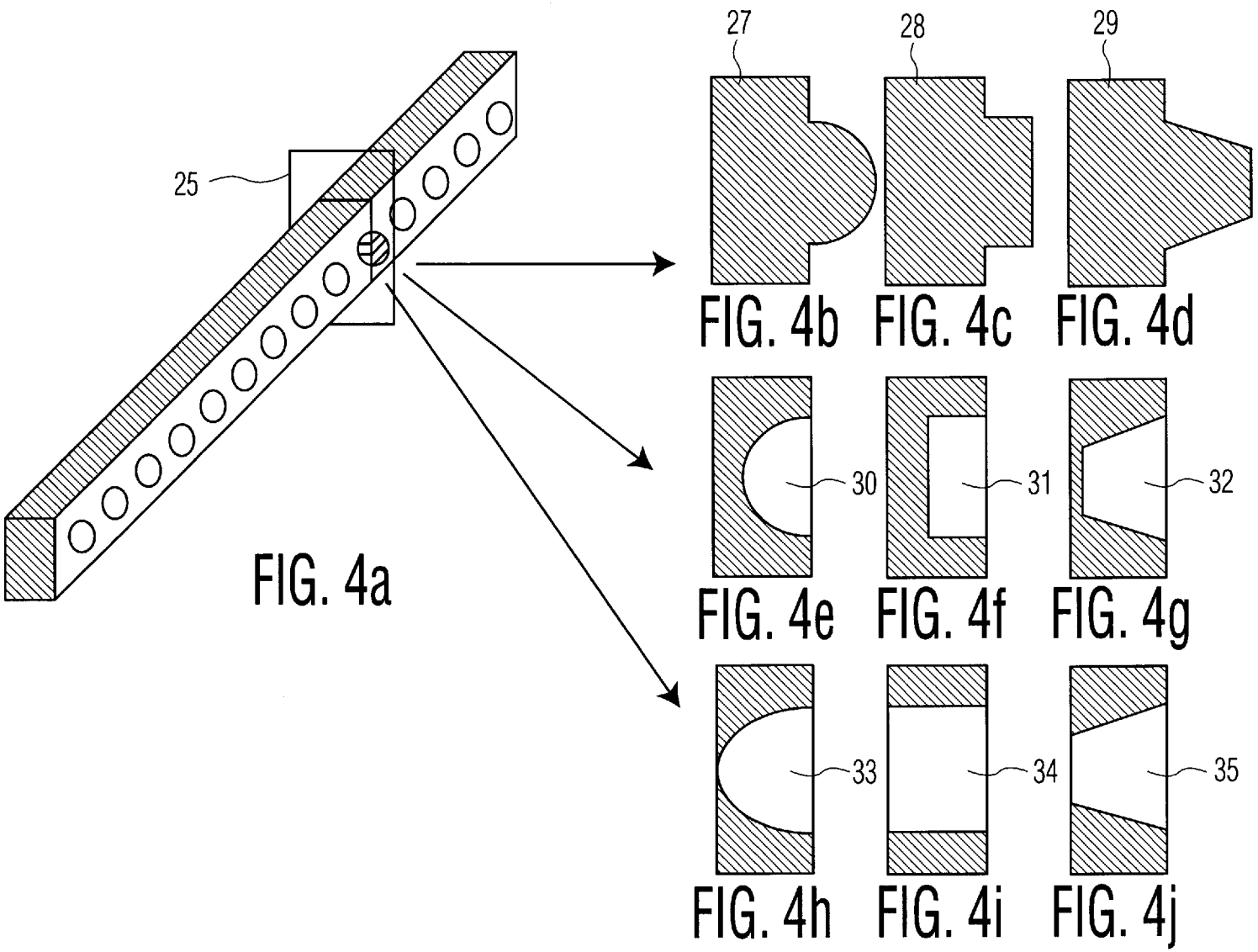
FIGS. 4*a*, 4*b*, 4*c*, 4*d*, 4*e*, 4*f*, 4*g*, 4*h*, 4*i*, 4*j* and 5*a*, 5*b*, 5*c*, 5*d*, 5*e*, 5*f*, 5*g* and 5*h* are charts of stub and recess profiles and of waveguide profiles for the drum and waveguide of FIG. 1, respectively.
Figure 5D:
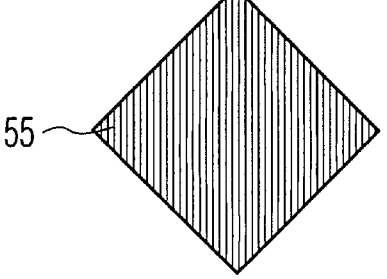
Figure 5B:
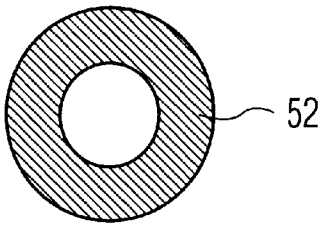
Figure 5E:
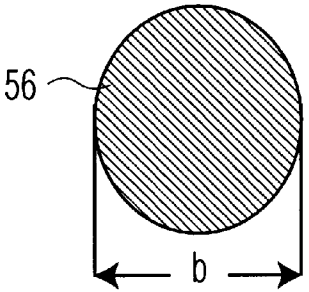
Figure 5G:
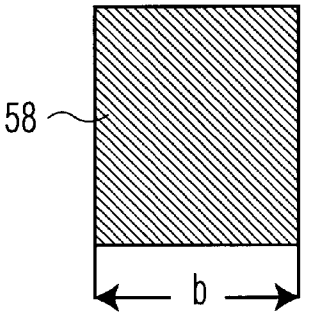
Figure 5F:
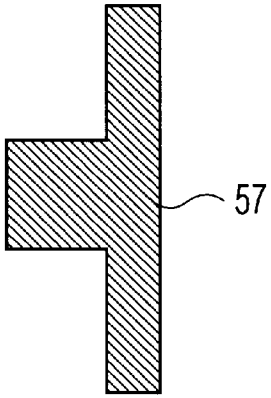
Figure 5C:
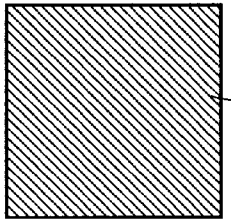
Figure 5H:
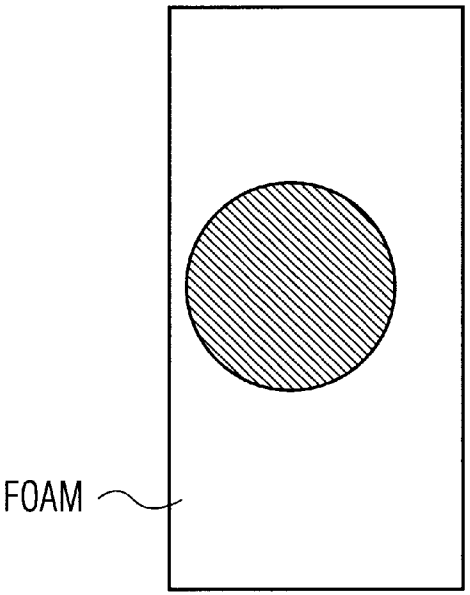
Figure 5A:
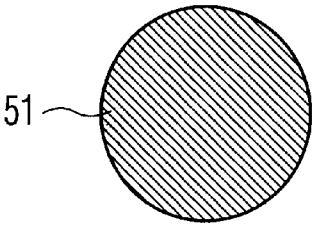

The features of the various rows of the apparatus of FIG. 1 may comprise holes, recesses or stubs. FIG. 4*a* demonstrates a cross section through an illustrative feature as indicated by plane 25. FIGS 4*b* through 4*j* illustrate nine alternative cross sections arranged in three rows. The top row as viewed shows illustrative stub profiles 27, 28, and 29. The middle row shows recesses 30,31, and 32. The bottom row shows holes 33,34, and 35.

Not only may the feature profile be different, the waveguide cross section also may be different. FIGS. 5*a* through 5*h* show illustrative cross sections for the waveguide. It is clear from the figures that the waveguide cross section may be disk-shaped (51), donut-shaped (52), square-shaped (53), diamond-shaped (55) (viz. square-shaped but rotated 90 degrees with respect to the coupled drum). The cross section also may be oval (56), T-shaped (57) or rectangular (58). The drum material may comprise quartz, Teflon™ polyethylene, polystyrene, sapphire, or microwave ceramic and may be embedded in foam or other material with a small dielectric constant and loss.

Figure 6A:
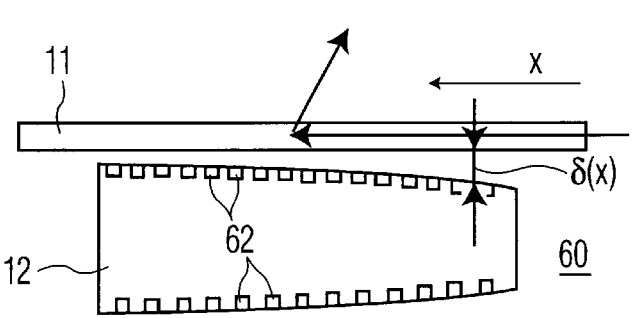
FIGS. 6*a*, 6*b*, 6*c*, 6*d*, 6*e* and 6*f* are charts of feature configurations and gap variations for the drum of FIG. 1 in accordance with the principles of this invention.
Figure 6B:
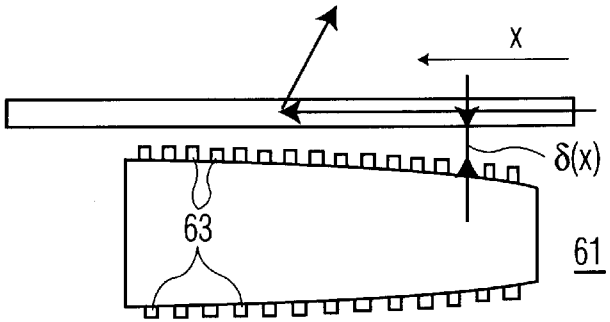
Figure 6C:
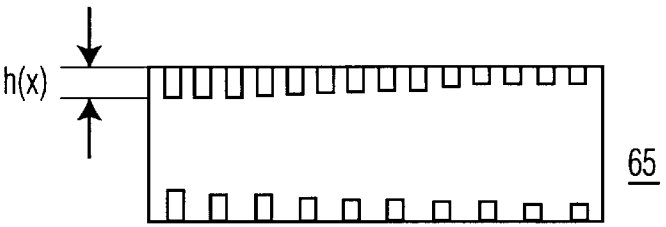
Figure 6D:
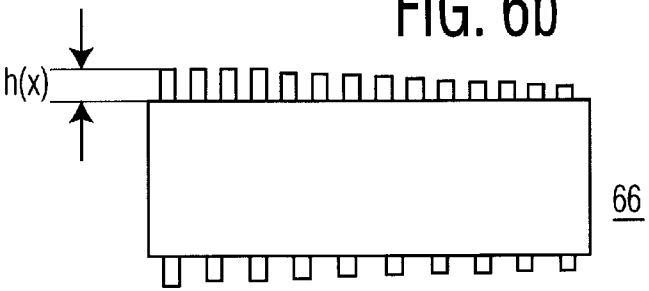
Figure 6E:
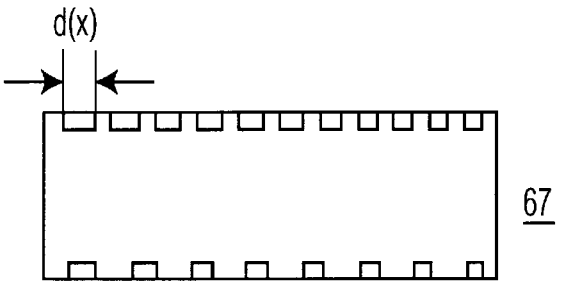
Figure 6F:
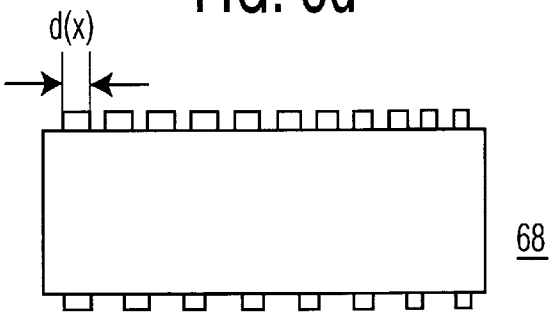

FIGS. 6*a* through 6*f* show an illustrative set of waveguide (11) and drum (12) variations. The gap between the drum and the waveguide may vary as shown at 60 and 61 in the FIGS. 6*a* and 6*b*, the representation at 60 illustrating the apparatus with recesses 62. The representation at 61 illustrates the apparatus with stubs 63. Further, the recess depth may vary as shown at 65 or the stub height may vary as shown at 66 as shown in FIGS. 6*c* and 6*d*. Also, the recess or stub diameter may vary as shown at 67 and 68, respectively as shown in FIGS. 6*e* and 6*f*.

Figure 7A:
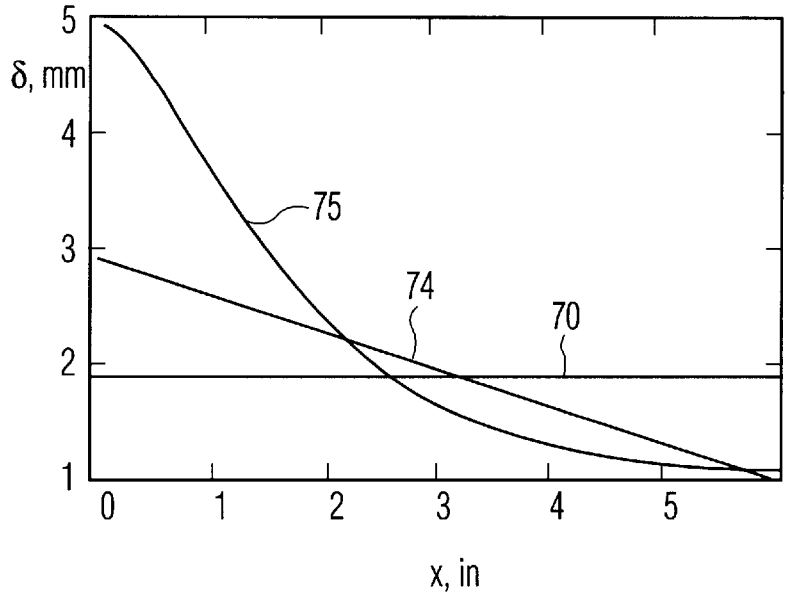
FIGS. 7*a* and 7*b* are graphs of different wave patterns for different gap profiles between the waveguide and drum of FIG. 1.
Figure 7B:
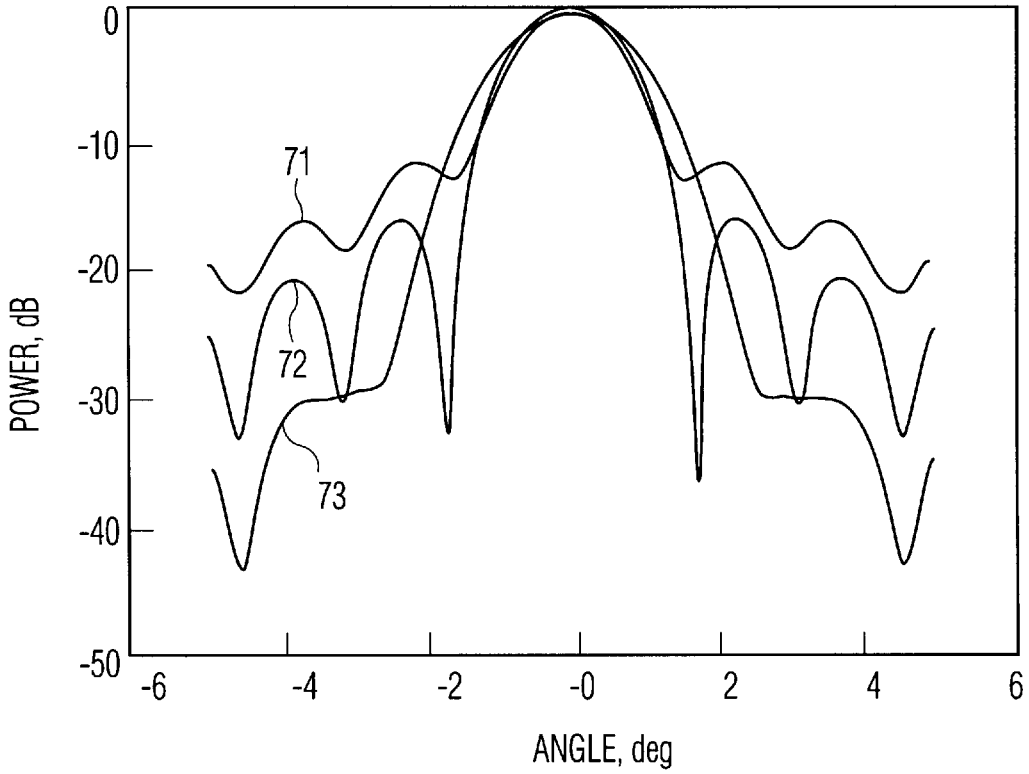

FIG. 7*a* is a graph of gap δ in mm versus X, the position along the waveguide of FIG. 6*a* at 60. FIG. 7*b* is a graph of power db versus the angle of the radiated beam. Curves in FIG. 7*b* correspond to the different gap arrangements of FIG. 7*a*. For a constant gap represented by horizontal line 70 in FIG. 7*a,* the power curve is as represented by curve 71 in FIG. 7*b*. For a straight line variation of about three millimeters at the end of the drum to about one millimeter at a six inch position as represented by line 74 in FIG. 7*a,* the power curve is as represented by curve 72 in FIG. 7*b*. A gap of from five millimeters at the end of the drum to one millimeter at the six inch position varying as represented by the curve 75 in FIG. 7*a,* produces a power curve represented by curve 73 in FIG. 7*b*.

Figure 8:
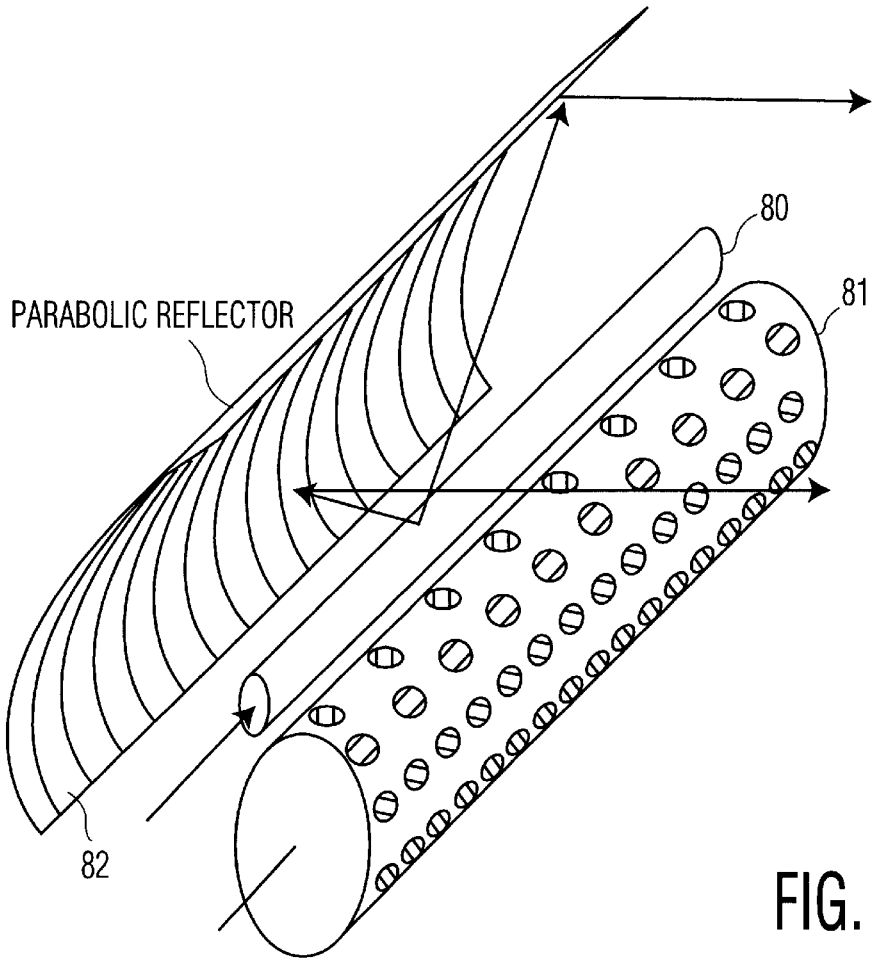
FIG. 8 is a schematic representation of an antenna as in FIG. 1 also including a parabolic reflector.
Figure 9:
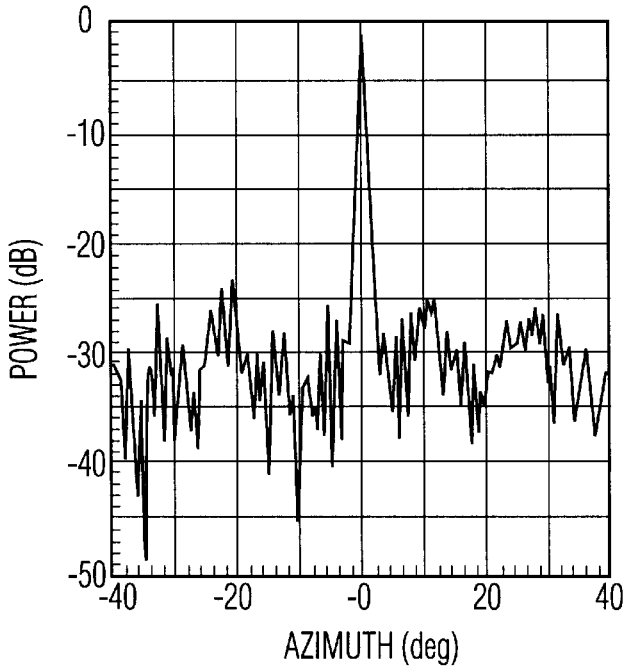
FIG. 9 is a graph of the beam profile radiated by the antenna of FIG. 8.

Parabolic reflectors are conveniently used with the scanning antenna of FIG. 1 in accordance with the principles of this invention for directing the beam from the antenna in elevation planes that are at angles to the azimuth X-Y plane. FIG. 8 shows one such apparatus with an oval-shaped waveguide 80 and a drum 81 with rows of recesses. The parabolic reflector is designated 82. FIG. 9 is a graph of power (dB) versus azimuth in degrees showing the far-field beam pattern. The power is −49 at an azimuth at −35 degrees, −45 at −10 degrees, and zero at the reference X-Y plane.

Figure 10:
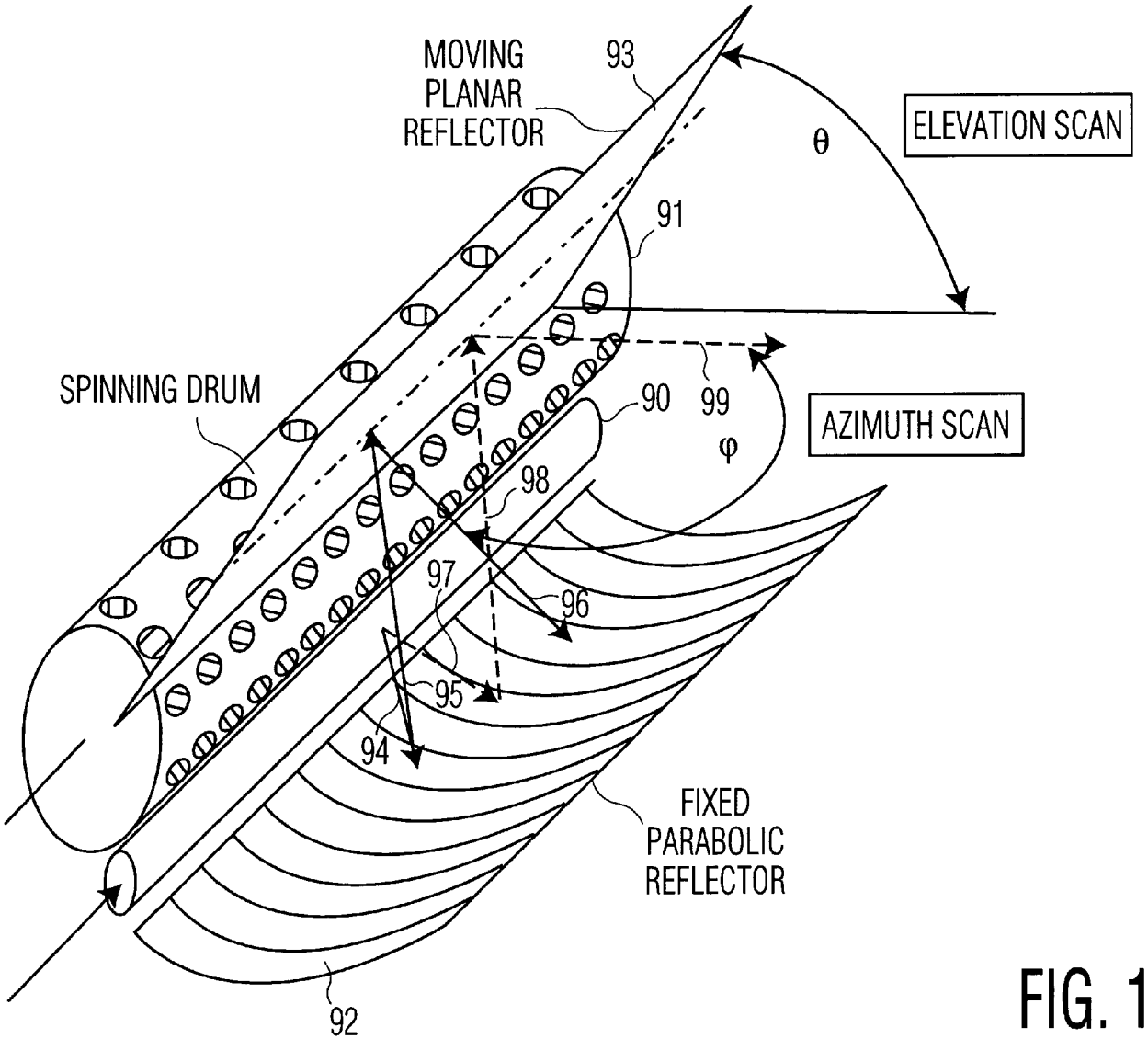
FIGS. 10 and 12 are schematic representations of the antenna of FIG. 1 with a parabolic reflector and a moving planar reflector and of a duplex system using such reflectors in both a transmitting mode and a receiving mode.

Two-dimensional beam steering can be achieved with the apparatus of FIG. 1 by employing a parabolic reflector which is in a fixed position and a planar reflector which moves. FIG. 10 illustrates such an arrangement. Specifically, FIG. 10 illustrates apparatus comprising a waveguide 90 having an illustrative oval cross section. The apparatus also includes a (spinning) drum 91 and a parabolic reflector 92. A planar reflector 93 rotates back and forth from a position in the plane of the axis of the drum as shown through an angle O to a position parallel to that axis. The directions of the beam are dictated by the positions of reflector 93. The solid arrows 94, 95, and 96 indicated the beam path from waveguide 90 to reflector 92 to reflector 93 in one position of reflector 93; the broken arrows 97, 98, and 99 indicate the beam path for a second position of reflector 93.

Figure 11:
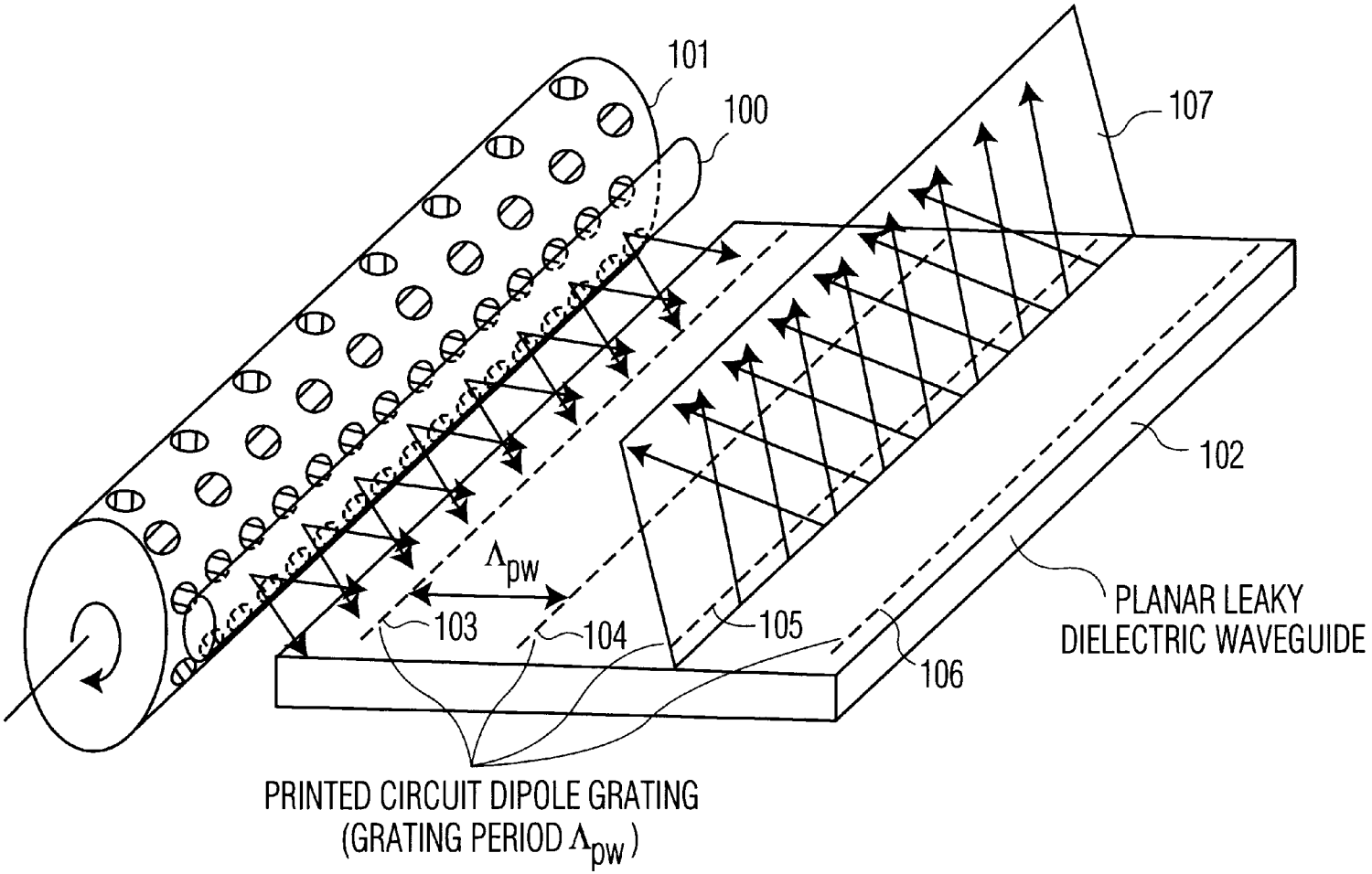
FIG. 11 is a schematic representation of the antenna of FIG. 1 with an additional planar, leaky dielectric waveguide.

FIG. 11 illustrates a waveguide 100 and an adjacent spinning drum 101 with rows of recesses. The apparatus also includes a planar, "leaky", dielectric waveguide 102 which has a printed circuit dipole grating formed on it. The grating is represented by dashed lines 103, 104, 105, and 106. Waveguide 102 is positioned in the path of the beam radiated from drum 101 as shown. The plane in which radiation is directed from waveguide 102 is represented at 107. This embodiment of the invention is particularly attractive when space is limited.

Figure 12:
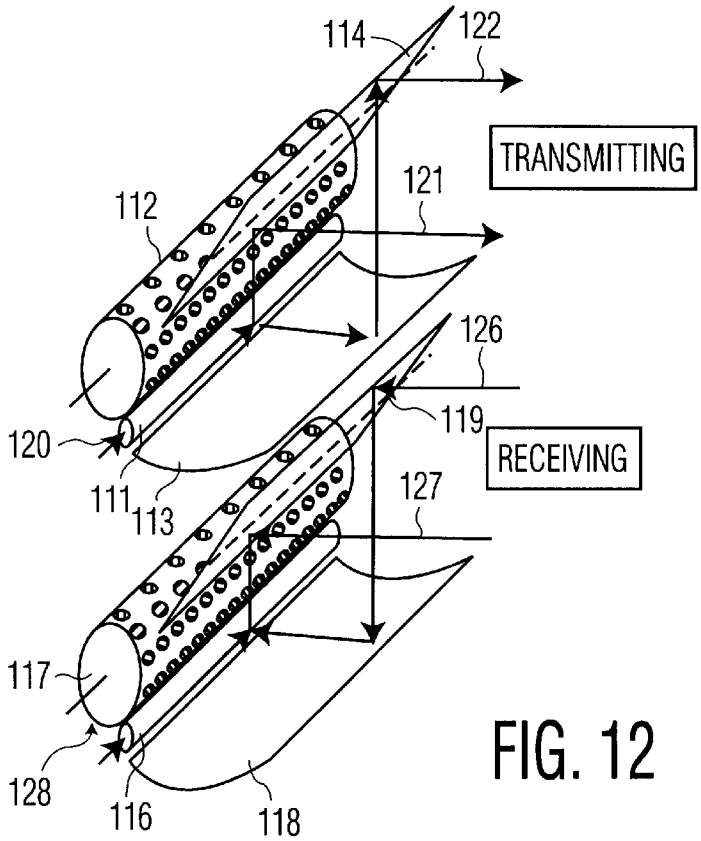

The apparatus represented in FIG. 1 is described in terms of a transmitting antenna. The apparatus also is useful as a receiving antenna. FIG. 12 illustrates one transmitting and receiving embodiment, both the transmitting antenna and the receiving antenna employing parabolic reflectors and a moving planar reflector. Specifically, the transmitting antenna of FIG. 12 includes a waveguide 11 and a spinning drum 112 with rows of recesses as shown. Antenna 112 also includes a parabolic reflector 113 and a moving planar reflector 114. The receiving antenna includes a waveguide 116, a spinning antenna 117, a parabolic reflector 118, and a moving planar reflector 119. An electromagnetic wave launched into waveguide 111 as indicated by arrow 120 is directed as indicated by the arrows 121 and 122 and received by the receiving antenna as indicated by solid arrows 126 and 127 to generate an electromagnetic wave as indicated by arrow 128.

Duplex beam steering can also be achieved without the two moving planar reflectors 114 and 119 of FIG. 12 with a shared spinning drum using two dielectric waveguides each with an associated parabolic mirror instead.

Figure 13:
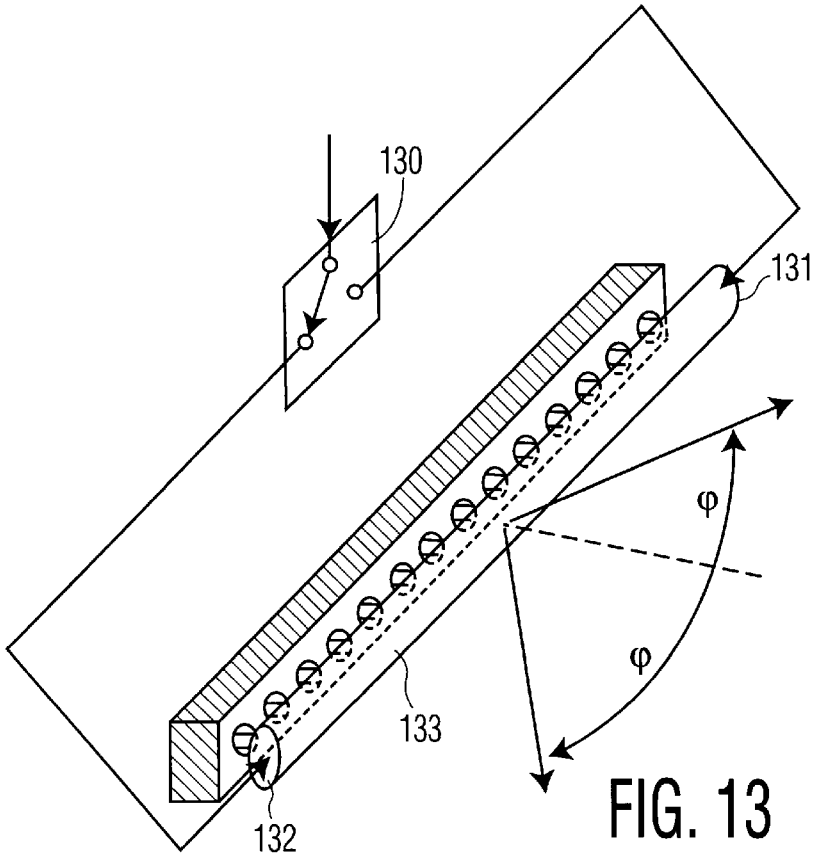
FIG. 13 is a schematic representation of a beam steering antenna with a switching mechanism.

A problem might appear when an antenna in accordance with the principles of the invention is designed to operate at relatively large scanning angles. The problem is overcome by using a switch to feed the antenna from opposite ends of the dielectric rod waveguides (DRW). Such an arrangement is illustrated in FIG. 13 where a switch 130 is operative to feed signals alternatively to end 131 and end 132 of the waveguide 133 as illustrated in the figure.

The number of beam positions in a lateral plane is determined by the number of rows of features on a drum. The number of rows on a drum determines the resolution. Antennas in accordance with the invention have a drum length of four to twenty inches with the spacing between rows of one wavelength. A drum may have twenty to eighty rows of features with the spacing between features of two to five millimeters. The drum typically is rotated at from one revolution per minute to twenty revolutions per second.

The use of stubs, recesses, or holes on the drum provides for increased efficiency per unit length, arbitrary polarization and for an increased coupling efficiency. Specifically, it has been found that when both, the waveguide and features have cross-section with rotating symmetry of $4^{th}$ order (square, round, octagonal etc.) the antenna can operate with arbitrary polarization, i.e. the main lobe of the antenna pattern for each fixed drum position is the same for any polarization. This includes such fundamental polarizations as horizontal and vertical polarizations, and right-hand and left-hand circular polarizations.

What is claimed is:

1. A scanning antenna comprising a rotatable cylinder having an outer surface and a first axis, an elongated dielectric waveguide having a second axis, said cylinder and said waveguide being located in positions closely spaced from one another such that electromagnetic signals in said waveguide are coupled to said cylinder, said cylinder comprising metallic material and including at said outer surface thereof a plurality of parallel rows of surface features, each surface feature in each of said plurality of rows having like X and Y dimensions, each of said surface features in a row having a first range of X and Y dimensions different from the range of said dimensions in every other one of said rows.

2. A scanning antenna as in claim 1 wherein the features of each of said plurality of rows are of vertical dimensions to change the distances between said cylinder and said waveguide over the length of said waveguide.

3. An antenna as in claim 1 wherein each of said surface features comprises a stub.

4. An antenna as in claim 3 wherein each of said stubs in a row has a different height.

5. An antenna as in claim 1 wherein each of said surface features comprises a recess in said outer surface.

6. An antenna as in claim 5 wherein each of said recesses in a row has a different depth.

7. An antenna as in claim 1 also including means for rotating said cylinder about said first axis.

8. An antenna as in claim 7 wherein said first and second axes are parallel to one another and said outer surface and said second axis also are parallel to one another.

9. An antenna as in claim 7 wherein said outer surface and said second axis define a varying gap therebetween.

10. An antenna as in claim 1 wherein said first and second axis are parallel to one another.

11. An antenna as. in claim 1 wherein said waveguide has a circular cross section.

12. An antenna as in claim 1 including means for introducing electromagnetic signals to said waveguide.

13. An antenna as in claim 12 wherein said means comprises a switch for introducing said signals from either end of said waveguide controllably.

14. An antenna as in claim 1 wherein all of said surface features in a row have the same X and Y dimensions.

15. An antenna as in claim 14 wherein the surface features of each row of said plurality of rows have circular cross sections.

16. An antenna as in claim 1 also including a reflector of a material and in a fixed position to reflect a beam emanating from said cylinder.

17. An antenna as in claim 16 wherein said reflector comprises a parabolic reflector.

18. An antenna as in claim 17 also including a second reflector.

* * * * *